US009200475B2

(12) United States Patent
Gallo et al.

(10) Patent No.: US 9,200,475 B2
(45) **Date of Patent: *Dec. 1, 2015**

(54) APPARATUS AND METHOD FOR VENDING SECURELY STORED PRODUCTS TO CONSUMERS

(75) Inventors: Michael Gallo, Brookfield, CT (US); Steve Sanelli, Woodbury, CT (US)

(73) Assignee: WIND CORPORATION, Danbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/291,500

(22) Filed: Nov. 8, 2011

(65) Prior Publication Data

US 2012/0125060 A1 May 24, 2012

Related U.S. Application Data

(63) Continuation of application No. 11/938,002, filed on Nov. 9, 2007, now Pat. No. 8,051,691.

(60) Provisional application No. 60/865,097, filed on Nov. 9, 2006.

(51) Int. Cl.
*E05B 11/00* (2006.01)
*E05B 35/12* (2006.01)
(Continued)

(52) U.S. Cl.
CPC ..... *E05B 35/12* (2013.01); *E05B 47/023* (2013.01); *G07F 7/0609* (2013.01); *E05B 13/004* (2013.01);
(Continued)

(58) Field of Classification Search
CPC ..... E05B 11/00; E05B 11/02; E05B 11/04; E05B 11/06; E05B 85/243; E05B 83/16; E05B 85/26; E05B 81/14; E05B 83/36; E05B 35/12; E05B 13/004; E05B 47/023; Y10T 403/602; E05C 3/24; G07F 7/0609; Y10S 70/62; Y10S 70/63
USPC ..... 70/389, DIG. 63, 390, 429, DIG. 62; 292/197, 198, 200, 216
See application file for complete search history.

(56) References Cited

U.S. PATENT DOCUMENTS 13,722 A 10/1855 Holmes et al.
214,251 A 4/1879 Ham
(Continued)

FOREIGN PATENT DOCUMENTS

DE 2342574 * 3/1975
DE 3437563 A1 4/1986
(Continued)

OTHER PUBLICATIONS

International Search Report from PCT/US07/03548 mailed Jan. 9, 2008.
(Continued)

*Primary Examiner* — Lloyd Gall
(74) *Attorney, Agent, or Firm* — Cantor Colburn LLP

(57) ABSTRACT

A lock mechanism is disclosed, the lock mechanism having a rotary latch configured for rotation between a locked position and an unlocked position, the rotary latch rotating in a first plane and the rotary latch is retained in the locked position after it has been rotated into the locked position from the unlocked position, the rotary latch being spring biased into the unlocked position by a biasing member; and a first lock mechanism for retaining the rotary latch in the locked position after rotation of the rotary latch into the locked position, the rotary latch being capable of being manipulated back into the unlocked position from the locked position after actuation of the first locking mechanism into a release position, wherein actuation of the first lock mechanism is in a second plane that is not parallel to the first plane.

3 Claims, 7 Drawing Sheets

(51) Int. Cl.

| | |
|---|---|
| ***E05B 47/02*** | (2006.01) |
| ***G07F 7/06*** | (2006.01) |
| *E05B 13/00* | (2006.01) |
| *E05C 3/24* | (2006.01) |

(52) U.S. Cl.

CPC .. *E05C 3/24* (2013.01); *Y10S 70/62* (2013.01); *Y10S 70/63* (2013.01); *Y10T 70/625* (2015.04); *Y10T 70/7441* (2015.04); *Y10T 70/7768* (2015.04); *Y10T 292/1047* (2015.04); *Y10T 292/1078* (2015.04); *Y10T 403/602* (2015.01)

(56) References Cited

U.S. PATENT DOCUMENTS

| | | | |
|---|---|---|---|
| 257,725 | A | 5/1882 | Lalor |
| 307,281 | A | 10/1884 | Farrar |
| 558,547 | A | 4/1896 | Burrows, Jr. |
| 781,185 | A | 1/1905 | Campbell |
| 885,559 | A | 4/1908 | Woodward |
| 900,437 | A | 10/1908 | Soley |
| 900,438 | A | 10/1908 | Soley |
| 925,900 | A | 6/1909 | Hansen |
| 930,534 | A | 8/1909 | Cox |
| 1,036,348 | A | 8/1912 | Schmittberger |
| 1,466,489 | A | 8/1923 | Starrett |
| 1,592,405 | A | 7/1926 | Worley, Jr. et al. |
| 1,592,406 | A | 7/1926 | Worley, Jr. |
| 1,716,169 | A | 6/1929 | Hart |
| 1,774,783 | A | 9/1930 | Worley, Jr. et al. |
| 1,902,547 | A | 3/1933 | Endter |
| 2,002,453 | A | 5/1935 | North |
| 2,047,795 | A | 7/1936 | North |
| 2,112,982 | A | 4/1938 | Brauning |
| 2,156,874 | A | 5/1939 | Schonitzer |
| 2,217,098 | A | 10/1940 | Brownne |
| 2,634,147 | A | 4/1953 | Robertson |
| 2,725,739 | A | 12/1955 | Check |
| 2,795,947 | A | 6/1957 | Peras |
| 2,910,859 | A | 11/1959 | Allen et al. |
| 3,023,600 | A | 3/1962 | Stahl et al. |
| 3,023,602 | A | 3/1962 | Foote et al. |
| 3,031,876 | A | 5/1962 | Foote et al. |
| 3,031,877 | A | 5/1962 | Foote et al. |
| 3,190,089 | A | 6/1965 | Foote et al. |
| 3,325,203 | A | 6/1967 | Moler |
| 3,429,153 | A | 2/1969 | Magyar |
| 3,447,348 | A | 6/1969 | Dauenbaugh |
| 3,451,704 | A | 6/1969 | Cothron |
| 3,691,799 | A | 9/1972 | Hoffmann et al. |
| 3,799,594 | A | 3/1974 | Watermann |
| 3,890,813 | A | 6/1975 | Cothron |
| 3,917,330 | A | 11/1975 | Quantz |
| 4,125,008 | A | 11/1978 | Genest et al. |
| 4,194,377 | A | 3/1980 | Maeda |
| 4,281,525 | A | 8/1981 | Bako |
| 4,395,064 | A | 7/1983 | Bellot et al. |
| 4,414,828 | A | 11/1983 | Takinami et al. |
| 4,438,964 | A | 3/1984 | Peters |
| 4,528,829 | A | 7/1985 | Bert et al. |
| 4,567,741 | A | 2/1986 | Trempala |
| 4,635,454 | A | 1/1987 | Brown |
| 4,648,253 | A | 3/1987 | Imhoff |
| 4,667,990 | A | 5/1987 | Quantz |
| 4,671,548 | A | 6/1987 | Haberle et al. |
| 4,682,483 | A | 7/1987 | Werner |
| 4,706,478 | A | 11/1987 | Swan et al. |
| 4,770,013 | A | 9/1988 | Nakai |
| 4,783,103 | A | 11/1988 | Schlegel |
| 4,838,054 | A | 6/1989 | Weinerman et al. |
| 4,979,384 | A | 12/1990 | Malesko et al. |
| 5,007,261 | A | 4/1991 | Quantz |
| 5,238,274 | A | 8/1993 | Becker et al. |
| 5,372,021 | A | 12/1994 | Smith |
| 5,473,922 | A | 12/1995 | Bair et al. |
| 5,611,224 | A | 3/1997 | Weinerman et al. |
| 5,918,916 | A | 7/1999 | Kajuch |
| 5,979,198 | A | 11/1999 | Haas-Trober et al. |
| 6,178,792 | B1 | 1/2001 | Glazier |
| 6,314,773 | B1 | 11/2001 | Miller et al. |
| 6,341,513 | B1 | 1/2002 | Chen |
| 6,401,505 | B1 | 6/2002 | Kajuch et al. |
| 6,460,708 | B2 | 10/2002 | Dean et al. |
| 6,622,534 | B1 | 9/2003 | Miller et al. |
| 6,685,242 | B2 | 2/2004 | Furner |
| 6,722,169 | B2 | 4/2004 | Segawa |
| 6,733,049 | B2 | 5/2004 | Piorkowski et al. |
| 7,269,984 | B2 | 9/2007 | Jackson |
| 7,458,239 | B1 | 12/2008 | Ma |
| 7,603,881 | B2 | 10/2009 | Yukihara et al. |
| 8,051,691 | B2 * | 11/2011 | Gallo et al. ..... 70/389 |
| 2004/0182120 | A1 | 9/2004 | Flory et al. |
| 2006/0001275 | A1 | 1/2006 | Plett et al. |
| 2006/0150693 | A1 | 7/2006 | Houlihan et al. |
| 2007/0193318 | A1 | 8/2007 | Churchill et al. |
| 2008/0134735 | A1 | 6/2008 | Gallo et al. |
| 2008/0196460 | A1 | 8/2008 | Houlihan et al. |
| 2008/0209962 | A1 | 9/2008 | Peot et al. |
| 2009/0241619 | A1 | 10/2009 | Kuester et al. |
| 2010/0263418 | A1 | 10/2010 | Moon |
| 2012/0013135 | A1 | 1/2012 | Moon |

FOREIGN PATENT DOCUMENTS

| | | | |
|---|---|---|---|
| DE | 10 2005 034 833 | | 2/2006 |
| EP | 1617024 | | 5/2005 |
| GB | 1 278 129 | | 6/1972 |
| JP | 20010271547 | * | 5/2001 |
| WO | 2007073800 | A1 | 7/2007 |

OTHER PUBLICATIONS

International Search Report for PCT/US07/15957 dated Jan. 9, 2008.
Written Opinion from PCT/US2007/003548 mailed Jan. 9, 2008.
Written Opinion from PCT/US07/15957, dated Jan. 9, 2008.
Letter from Christopher C. Boehm to Mr. David Grover or any individuals associated with the prosecution of U.S. Appl. No. 11/774,038 at Calfee, Halter & Griswold, Regarding U.S. Appl. No. 11/774,038. Mailed on Mar. 21, 2011. 2 pages.
Letter from David J. Grover to Mr. Christopher C. Boehm Regarding U.S. Appl. No. 11/774,038. Mailed on Mar. 28, 2011, 2 pages.
Letter from Christopher C. Boehm to Mr. David Grover Regarding U.S. Appl. No. 11/774,038. Mailed Apr. 1, 2011. 2 pages.
Email from David Grover to Christopher C. Boehm regarding, U.S. Appl. No. 11/774,038. Sent on Apr. 8, 2011 at 1:04pm. 4 pages.
Letter from Christopher C. Boehm to Mr. David Grover Regarding U.S. Appl. No. 11/774,038., Mailed on Apr. 29, 2011. 1 page.
Machine Translation for DE 23 42 574.
Machine Translation for EP 1617024.

* cited by examiner

APPARATUS AND METHOD FOR VENDING SECURELY STORED PRODUCTS TO CONSUMERS

CROSS REFERENCE TO RELATED APPLICATIONS

This application is a continuation of U.S. patent application Ser. No. 11/938,002 filed Nov. 9, 2007, now U.S. Pat. No. 8,051,691, which claims the benefit of U.S. Provisional Patent application 60/865,097 filed Nov. 9, 2006, the contents each of which are incorporated herein by reference thereto.

BACKGROUND

This application relates to methods for vending retail products to consumers, and more specifically to a method for vending sensitive retail products that must be stored in a secure location to consumers.

Because propane gas is extremely flammable and explosive, the storage and transportation of propane using propane tanks requires a great deal of precaution and is regulated by both federal and state law. As a result, the propane tanks used to store and transport propane gas can be expensive. To avoid the cost of paying for a new tank each time more propane gas is needed, many consumers, particularly those using propane for gas grills, use refillable propane tanks that can be taken to a propane distributor or a retail distributor for a refill whenever more propane is needed.

In recent years, to provide a safer and more convenient method for refill centers to supply propane, propane tank exchange programs have been introduced. A typical propane tank exchange program operates by having a consumer bring an old tank to the refill center, drop the tank off at an exchange display outside the store entrance, inform a cashier that he or she would like to exchange the empty tank and purchase a full tank, follow a store representative to a tank display unit, and take a full propane tank after the store representative unlocks the tank display unit.

While refill and exchange programs have been utilized for propane tanks and other products, both program types are inherently inefficient for retail centers. For example, consumers must wait while an attendant refills or walks to a display unit to exchange a propane tank (which increases the likelihood of lines forming), more staffing time is required, and staff must be trained to handle, and do handle, hazardous propane.

Accordingly, it is desirable to provide a system, apparatus and a method for vending a sensitive product that must be stored in a secure location, such as a propane tank, to a consumer in a manner that is safe, convenient, and secure; reduces labor cost; and can be implemented in a cost efficient manner.

SUMMARY

Exemplary embodiments of the present invention relate to a method for distributing a product that is stored in a secured vending receptacle to consumers. In one exemplary embodiment, the present invention allows distribution of sensitive products in a manner that is cost efficient, secure, convenient, and safe, while being mindful of the constraints presented by the use of a secured vending receptacle.

In accordance with one exemplary embodiment of the present invention, a method for vending a secured product to a consumer is provided, wherein the method comprises: depositing a product into a storage receptacle accessible through a front door having a locking mechanism, the storage receptacle being configured to house the product, the locking mechanism being configured to secure the front door in a closed position when disposed in a locked state and to permit the front door to be opened when disposed in an unlocked state, the locking mechanism being predisposed in the locked state; releasing a vendee key configured to compel the locking mechanism of the storage receptacle to the unlocked state; transferring the released vendee key to a consumer, whereby the consumer uses the vendee key to compel the locking mechanism of the storage receptacle to the unlocked state and accesses the storage receptacle to obtain the product; and capturing the vendee key with the locking mechanism after the vendee key has been used to compel the locking mechanism to the unlocked state, wherein the vendee key cannot be used again unless subsequently released by a vendor key.

In accordance with another exemplary embodiment of the present invention, provision is made for a vending structure of the type comprising a plurality of storage receptacles each configured to house a refillable container of the type configured hold a product and each having a front door and a locking mechanism. The locking mechanisms are configured to secure the front doors of the respective storage receptacles in a closed position when disposed in a locked state and to permit the front doors of the respective storage receptacles to be opened when disposed in an unlocked state. The locking mechanisms are predisposed in the locked state, and each locking mechanism is configured to be compelled to the unlocked state by a corresponding vendee key and to thereafter capture the corresponding vendee key.

In the practice of this exemplary embodiment, a method of vending secured products to consumers from a vending structure of the type described comprises the steps of removing empty refillable containers from the plurality of storage receptacles to the extent that empty refillable containers are present; depositing refillable containers holding the product into the plurality of storage receptacles to the extent that storage receptacles are present in which refillable containers are not deposited; releasing a corresponding vendee key for each locking mechanism of the plurality of storage receptacles for which a corresponding vendee key has not been released; transferring a released vendee key for each purchase of the product to a purchasing consumer, whereby each purchasing consumer uses the vendee key transferred for their purchase to compel the corresponding locking mechanism to the unlocked state, access the corresponding storage receptacle to obtain a refillable container holding the product, and deposit an empty refillable container into the corresponding storage receptacle; and capturing each vendee key with the corresponding locking mechanism as each vendee key is used to compel the corresponding locking mechanism to the unlocked state, wherein each vendee key, when captured, cannot be used again unless subsequently released by a vendor key.

In another exemplary embodiment, a lock mechanism is disclosed, the lock mechanism having a rotary latch configured for rotation between a locked position and an unlocked position, the rotary latch rotating in a first plane and the rotary latch is retained in the locked position after it has been rotated into the locked position from the unlocked position, the rotary latch being spring biased into the unlocked position by a biasing member; and a first lock mechanism for releasing the rotary latch from the locked position after actuation of the first lock mechanism, the biasing member rotating the rotary latch into the unlocked position, the rotary latch being capable of being manipulated back into the locked position from the unlocked position after release by the first locking mechanism and the first locking mechanism must be reset in order to once again release the rotary latch.

A lock mechanism is disclosed, the lock mechanism having a rotary latch configured for rotation between a locked position and an unlocked position, the rotary latch rotating in a first plane and the rotary latch is retained in the locked position after it has been rotated into the locked position from the unlocked position, the rotary latch being spring biased into the unlocked position by a biasing member; and a first lock mechanism for retaining the rotary latch in the locked position after rotation of the rotary latch into the locked position, the rotary latch being capable of being manipulated back into the unlocked position from the locked position after actuation of the first locking mechanism into a release position, wherein actuation of the first lock mechanism is in a second plane that is not parallel to the first plane and wherein the first lock mechanism must be reset in order to subsequently release the rotary latch from the locked position.

DETAILED DESCRIPTION OF EXEMPLARY EMBODIMENTS

Exemplary embodiments of the present invention relate to a method and apparatus for distributing a product that is stored in a secured vending receptacle to consumers. In one exemplary embodiment, a method of the present invention allows distribution of sensitive products in a manner that is cost efficient, secure, convenient, and safe, while being mindful of the constraints presented by the use of a secured vending receptacle.

Figure 1:
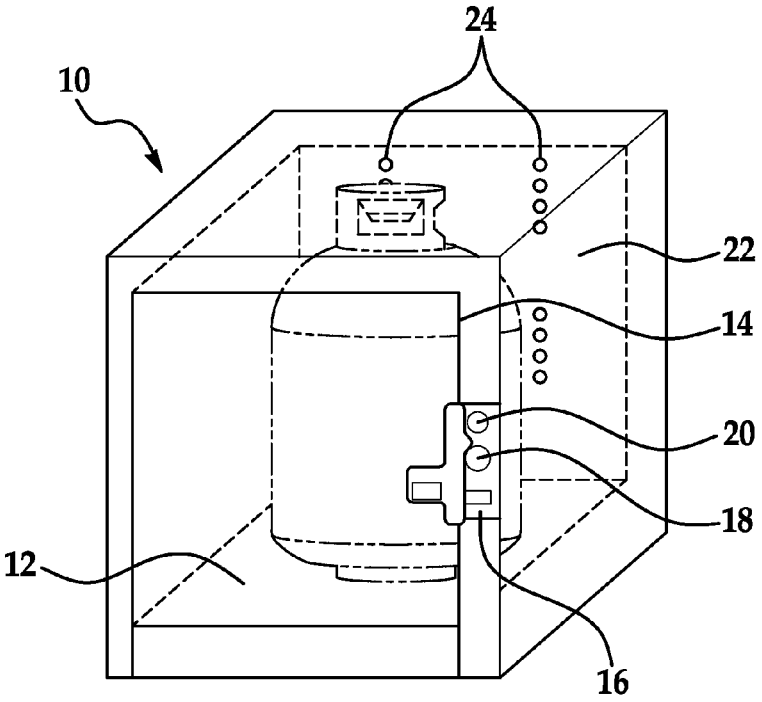
FIG. 1 is a perspective view of an exemplary storage receptacle for use in an exemplary embodiment of the present invention.

In accordance with an exemplary embodiment of the present invention, a product that is secured in a storage receptacle is vended to a consumer. An exemplary embodiment of such a storage receptacle is illustrated in FIG. 1, which will now be explained. Storage receptacle 10 comprises a compartment 12 configured to house the product, a front door 14, and a locking mechanism 16 configured to secure front door 14 in a closed position when disposed in a locked state and to permit front door 14 to be opened when disposed in an unlocked state. Locking mechanism 16 is predisposed in the locked state and has a two-keyway design consisting of a vendee keyway or key opening 18 and a vendor keyway or key opening 20.

In accordance with the an exemplary embodiment of the present invention, the product to be distributed can consist of whatever the retailer desires to vend in a secured or controlled fashion, but the method of exemplary embodiments of the present invention is/are particularly well-suited for the distribution of sensitive items that are expensive (for example, laptops), hard to replace, or hazardous (for example, propane tanks). The dimensions of the compartment can be any height, width, and depth combination suitable for housing the product, and the compartment can formed from any material or any combination of materials suitable for housing the product (for example, stainless steel, aluminum, or polymeric resin). The compartment can also be ventilated if required. By way of illustration, in the exemplary embodiment of FIG. 1, a rear panel 22 of the compartment 12 has a plurality of circular ventilating apertures 24. The operation of the locking mechanism of an exemplary embodiment can be mechanical or electrical without departing from the principles of exemplary embodiments of the present invention.

In carrying out an exemplary embodiment of the present invention, the storage receptacle can be placed in any location suitable for vending the product to be distributed (for instance, the storage receptacle can be located in a corridor where a consumer can have after-hours access). If the product is a propane tank, for example, the propane tank must be stored in an upright position in a ventilated storage receptacle that is located where exposure to extreme temperature change, physical damage, and tampering is limited. More specifically, the propane tank should be kept in a metal storage receptacle that is outside and no less than 20 feet from doorways or openings to the retail or vending center.

In accordance with an exemplary embodiment of the present invention, the method comprises the steps of depositing a product into a storage receptacle, releasing a vendee key that can be used to compel the locking mechanism of the storage receptacle to the unlocked state, transferring the released vendee key to a consumer (whereby the consumer can use the vendee key to compel the locking mechanism of the storage receptacle to the unlocked state and be permitted to open the front door of the storage receptacle to access the compartment and obtain the product), and capturing the vendee key after the vendee key has been used to compel the locking mechanism to the unlocked state so that the vendee key cannot be used unless subsequently released.

Figure 2:
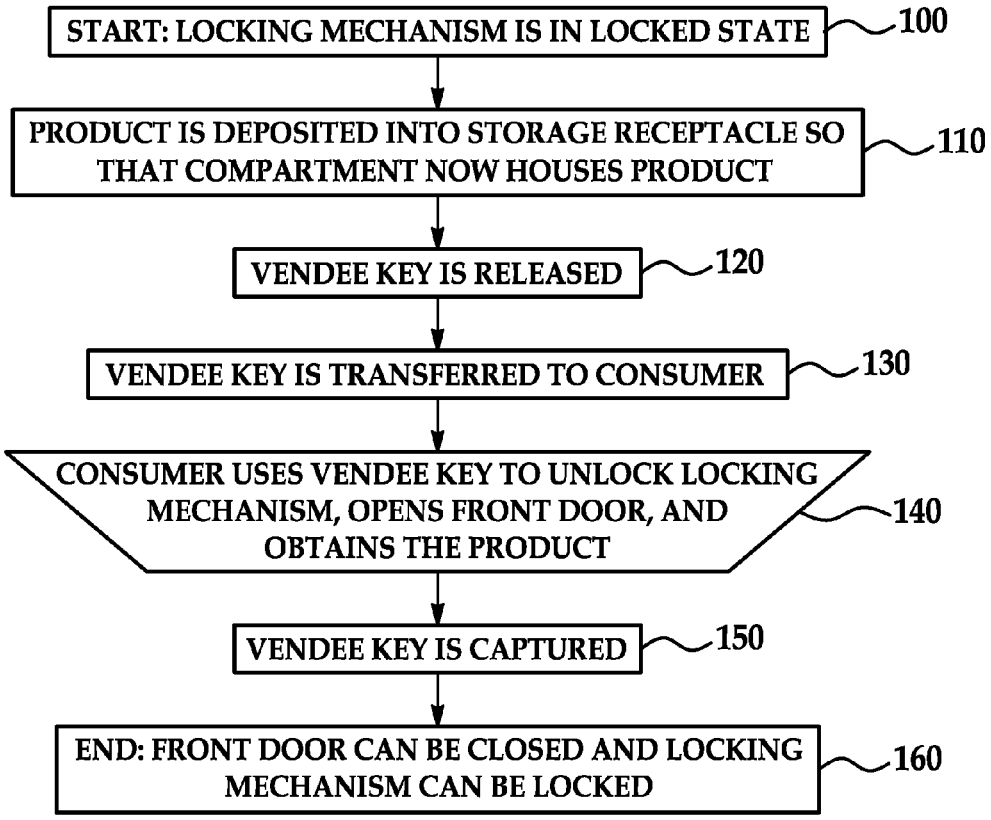
FIG. 2 is a schematic illustration of an exemplary embodiment of the present invention.

In accordance with an exemplary embodiment of the present invention, the flowchart of FIG. 2 illustrates an exemplary embodiment of the method of vending a secured product to a consumer. In a non-limiting example, the steps of FIG. 2 can be implemented using the exemplary storage receptacle 10 of FIG. 1 described above. As shown as step 100, the method starts with the locking mechanism disposed in the locked state.

Step 110, depositing the product into a storage receptacle, can be completed in a number of way without departing from the invention. For example, the storage receptacle can include a rear door panel, which allows an attendant, or a courier to reduce labor costs and heighten safety and security, to easily deposit the product into the compartment by opening a rear door (the courier or attendant can be provided with a specific turnkey, keycard, or access code for unlocking the rear door). The storage receptacle can also be front-loading through the front door.

In carrying out an exemplary embodiment of the present invention, the vendee key can be of any form suitable for compelling the locking mechanism to the unlocked state. For instance, if the locking mechanism is mechanical, the vendee key can consist of a token (which can be deposited through a slot and into a token retaining housing to unlock the locking mechanism) or a stainless steel turnkey (which can be rotated in a keyhole to unlock the locking mechanism). If the locking mechanism is electrical, the vendee key can consist of a user-assigned access code (which can be entered into a keypad to unlock the locking mechanism), or a keycard with information stored on a magnetic strip (which can be inserted into a card reader and read by software to unlock the locking mechanism when activated). The vendee key can be manufactured or generated in a proprietary fashion to prevent against duplication or repeated use.

In accordance with an exemplary embodiment of the present invention, the vendee key is considered as being released when it is available to be used to unlock a locked locking mechanism (that is, the vendee key is not captured). Step 120, releasing the vendee key, will be described in greater detail below.

Step 130, transferring the released vendee key to a consumer, may be done in a number of ways without departing from the principles of exemplary embodiments of the present invention. The step can consist of, for example, handing a turnkey to the consumer, handing or dispensing a token or keycard to the consumer, or communicating a user-assigned access code or pin to the consumer. The transfer can take place at a remote, central location, and therefore requires minimal attendant labor and consumer wait time. By way of illustration, if the storage receptacle is kept outside, an attendant can make the transfer at a location inside a retailer's store so that the consumer will enter the store and potentially purchase additional items. An exemplary embodiment of the present invention also permits the transferring step to be made without an attendant, for example, through the use of an automated machine that dispenses a token or keycard, or communicates an access code.

As shown at step 140, once the vendee key has been transferred to the consumer, the consumer can use the vendee key to unlock the locking mechanism and in so doing can open the front door of the storage receptacle to access the compartment and obtain the product. That is, once the front door has been unlocked, the consumer can open the front door by, for example, by pulling the locking mechanism, or the front door can be configured to self-open upon being unlocked.

Figure 3:
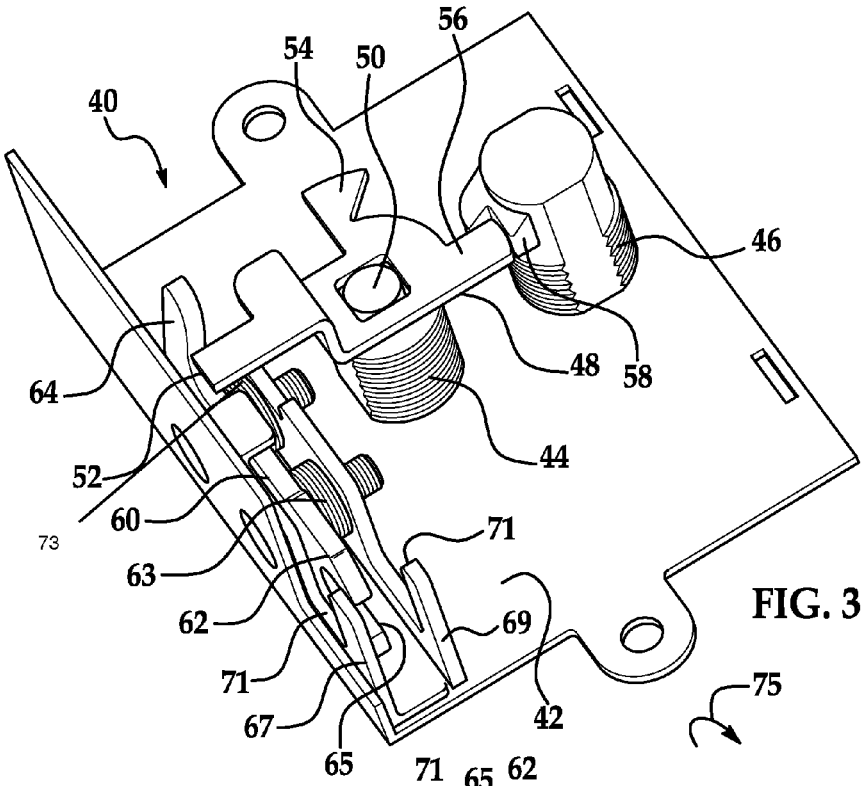
FIGS. 3-4A are perspective views of an exemplary locking mechanism for use in an exemplary embodiment of the present invention.
Figure 4:
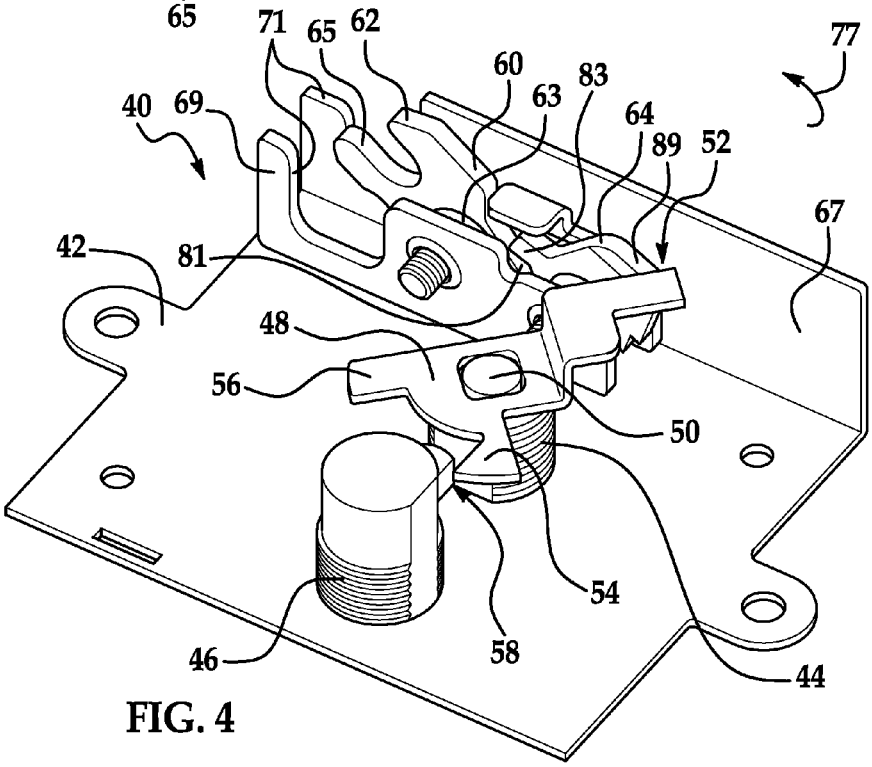

Step 150, capturing the vendee key after the vendee key has been used to unlock the locking mechanism, secures the integrity of the system. In a non-limiting example, the capturing of the vendee key can coincide with the opening of the front door of the locking mechanism. The capturing can consist of, for example, trapping a turnkey in a mechanical locking mechanism (as illustrated in FIGS. 3-4, described below), retaining a token vendee key in a token retaining housing after the token has been inserted into the locking mechanism, or deactivating an access code or keycard so that it cannot be used to unlock the locking mechanism a second time. Therefore, when front door is closed and the locking mechanism is subsequently locked, as can be performed at step 160, the consumer cannot use the captured vendee key to re-enter the compartment.

A non-limiting example of the locking mechanism in accordance with an exemplary embodiment is the latch assembly illustrated in FIGS. 3-4. Latch assembly 40, shown following the release of a vendee key in FIG. 3, consists of a housing plate 42 that can be mounted on the front door of a storage receptacle or locker. Latch assembly 40 has a two-keyway design consisting of a first lock housing, lock device or first lock mechanism 44 having a keyway (not shown) configured to receive a vendee key and a second lock housing, lock device or locking mechanism 46 having a keyway (not shown) configured to receive a vendor key.

Referring now to FIGS. 3 and 4, latch assembly 40 is shown with a rotary latch 60 in the locked position. Rotary latch 60 includes an actuator or latch portion 62 and a latch trigger 64. In accordance with an exemplary embodiment of the present invention rotary latch 60 is rotatably mounted to lock housing 42 and the rotary latch is spring biased into the open position by a spring 63. In accordance with an exemplary embodiment, the rotary latch has an opening or feature 65 configured to engage a feature of the locker or receptacle when the actuator is in the locked position.

Housing 42 has an outer wall portion 67 and a spaced apart inner wall portion 69 defining a cavity in which rotary latch 60 is able to rotate. Wall portion 67 and wall portion 69 each have an opening 71 to receive a catch or bolt of the locker frame at the same time the opening of the rotary latch engages the catch or bolt of the locker or receptacle. In accordance with an exemplary embodiment of the present invention the opening or feature of the rotary latch is off set 90 degrees with respect to the openings of wall portions 67 and 69, when the rotary latch is in the latched position shown in FIG. 3. In the locked position shown, rotary latch 60 engages a bolt (not shown) that is connected the inside wall of a storage receptacle.

Once the actuator is in the locked position, the actuator is retained in the locked position by the latch trigger, which is spring biased by a spring 73 in a direction opposite to the spring biased direction of the actuator thus, as the actuator is rotated or pivoted into a locked position (FIG. 3) a portion of the latch trigger is biased into a complementary feature of the rotary latch so that the same is retained in the position illustrated in FIG. 3.

Disposed on the inside end of first lock housing, first locking device or first locking mechanism 44 is a cam mount 50 that is used to mount a cam member 48. Cam mount 50 rotates after the first locking device has been unlocked via a key, combination electrical or otherwise and the lock is now free to rotate such that rotation of cam mount 50 causes rotation of the cam mounted thereto. As illustrated, cam member 48 has a latch engaging or trigger engaging projection 52, a first stopping projection 54, and a second stopping projection 56. As illustrated in FIG. 3, following the release of a vendee key, the second stopping projection 56 of cam member 48 rests against a cam stop 58 on second housing or second locking device 46, and latch-engaging projection 52 rests in a location proximate to latch trigger 64 of rotary latch 60.

Figure 5:
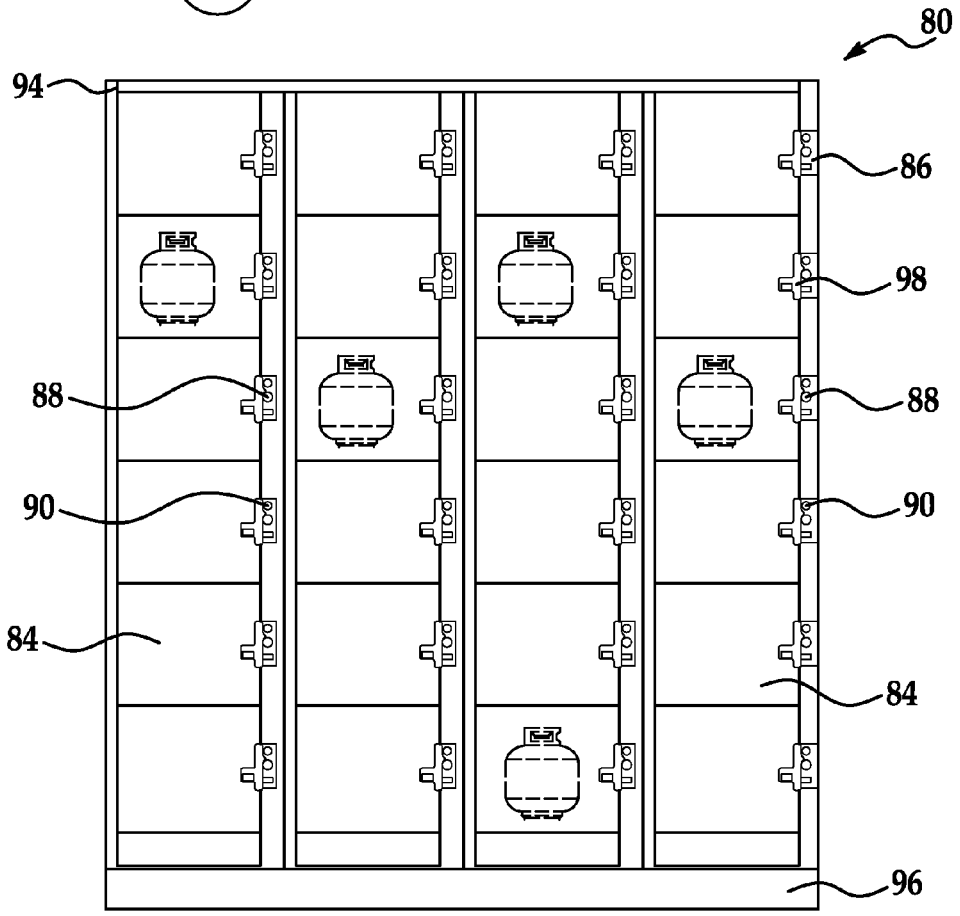
FIG. 5 is a plain front view of an exemplary vending structure for use in an exemplary embodiment of the present invention.

As illustrated in FIGS. 3 and 4, the rotary latch is spring biased in the direction of arrow 75 and the latch trigger is spring biased in the direction of arrow 77 thus as the rotary latch is rotated from the open position (FIG. 4) to the closed position of FIG. 5 by a bolt or hasp engaging opening 65 the biasing force in the direction of arrow 75 is overcome and the rotary latch moves into the position of FIG. 4 at this point a feature, shoulder or notch 81 is positioned to engage a stop portion 83 of the latch trigger which is free to rotate into the direction of arrow 77 until stop portion 83 engages feature 81 thus locking the rotary latch in place (FIG. 3).

Figure 4A:
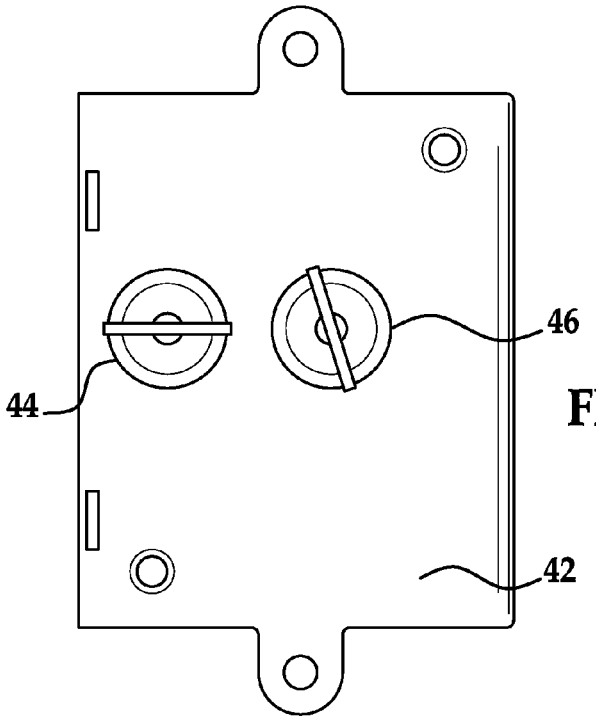

To unlock latch assembly 40 and as viewed from an exterior surface of the latch assembly (FIG. 4A), a consumer unlocks the first lock mechanism by for example inserting the vendee key into the keyway of first housing 44 and rotates the vendee key 45° counterclockwise, thereby causing cam member 48 to rotate counterclockwise. In accordance with an exemplary embodiment, the first lock mechanism comprises a plug rotatably received within a housing wherein rotation of the plug is facilitated by inserting a key into the plug and rotating the key and thus the plug, which is secured to the cam at one end. Once the key is inserted a plurality of pins are depressed in accordance with known technologies thus allowing rotation of the plug within the lock housing. As a result of the rotation, latch-engaging projection 52 of cam member 48 contacts the latch trigger 64 and rotates latch trigger in a direction opposite to arrow 77 wherein the stop member 83 no longer engages the notch 81 of the rotary latch and the biasing force of spring 63 causes the rotary latch to rotate into the unlocked position (FIG. 4) wherein the hasp or bolt is no longer engaged. As illustrated in FIG. 4, the latch-engaging projection 52 is configured as a planar member that is configured to directly contact the rotary latch.

Following this rotation, the vendee key is captured since the lock housing or plug is rotated by the key to a point where internal pin tumblers are depressed thereby preventing removal of the key. That is, the vendee key cannot be turned in either direction to a position where the key can be removed because latch-engaging projection 52 of cam member 48 is blocked from rotating in the clockwise direction by latch trigger 64, and first stopping projection 54 of cam member 48 is blocked from rotating in the counterclockwise direction by cam stop 58 of second housing 46, as illustrated in FIG. 4. As shown in FIG. 4 and referring to the view illustrated for directional purposes clockwise rotation of cam member 48 prevented by projection 54 engaging the lock projection 58 and counterclockwise rotation is prevented by projection 52 engaging an end portion 89 of the latch trigger.

Therefore, the vendee key cannot be removed from first housing 44 and the rotary latch can only be manipulated back into the locked position illustrated in FIG. 3. At this point, the consumer can open the front door of the unlocked storage receptacle by pulling on the trapped vendee key to access the compartment and obtain the product.

In accordance with an exemplary embodiment, it is contemplated that after the vendee key has been used to unlock the locking mechanism and subsequently captured, the front door of the storage receptacle can be closed and locked since the rotary latch can rotate from the unlocked position to the unlocked position and then the latch trigger will engage the rotary latch. For example, the locking mechanism can be arranged to automatically lock upon the closing of the front door, and, to provide additional security, the storage receptacle can include hinges so that the front door can be self-closing. In the particular exemplary locking mechanism illustrated in FIGS. 3-4, when the consumer has finished accessing the compartment and closes the front door, actuator 62 of rotary latch 60 engages with the bolt on a sidewall of the storage receptacle to lock the storage receptacle.

In accordance with an exemplary embodiment, once the vendee key is captured, it cannot be used again unless subsequently released. The step of releasing a vendee key can consist of, by way of example, removing a trapped turnkey from the locking mechanism using a manager or vendor key, removing a token vendee key from a token retaining housing within the locking mechanism using a vendor key that opens the token retaining housing, or programming an access code or activating a keycard that the software of an electrical locking mechanism will accept to unlock the locking mechanism.

In the particular exemplary locking mechanism illustrated in FIGS. 3-4, a vendor key is used to release the captured vendee key from latch assembly 40. When the vendee key is captured in latch assembly 40 as illustrated in FIG. 4, the store manager or vendor can release the vendee key from first housing 44 by sequentially following the steps of: 1) inserting the vendor key into second lock or second lock housing 46; 2) rotating and holding the vendor key 90° in either direction, thereby causing cam stop 58 to be retracted and moved from position wherein it is engaging the first stopping projection 54 of cam member 48; 3) while holding the vendor key in the rotated position, rotating the vendee key approximately 315° counterclockwise in first housing 44 so that second stopping projection 56 of cam member 48 is again resting against cam stop 58 and projection 52 is positioned to once again engage the trigger by further counterclockwise rotation of the vendee key; and 4) removing the vendee key from first housing 44 as well as removal of the vendor key and resetting of the locking mechanism. Although degrees of rotation are described herein exemplary embodiments contemplate degrees of rotation greater or less than the aforementioned values. During the release and removal of the vendee key, the storage receptacle remains locked and the front door remains closed.

It being further understood that directional rotations when viewed from the front side of the lock (FIG. 4A) are opposite when view from the rear side of the lock (FIGS. 3 and 4). In other words, counterclockwise rotation of the first lock housing when viewed from the front is clockwise when viewed from the back (FIGS. 3 and 4).

In accordance with an exemplary embodiment of the present invention a lock mechanism is disclosed, the lock mechanism comprising: a rotary latch configured for rotation between a locked position and an unlocked position, the rotary latch rotating in a first plane and the rotary latch is retained in the locked position after it has been rotated into the locked position from the unlocked position, the rotary latch being spring biased into the unlocked position by a biasing member; and a first lock mechanism for releasing the rotary latch from the locked position after actuation of the first lock mechanism, the biasing member rotating the rotary latch into the unlocked position, the rotary latch being capable of being manipulated back into the locked position from the unlocked position after release by the first locking mechanism and the first locking mechanism must be reset in order to once again release the rotary latch.

In accordance with an exemplary embodiment of the present invention, a series of products in secured refillable containers are vended to consumers from a vending structure having a plurality of storage receptacles. Pursuant to this exemplary embodiment, each storage receptacle has a compartment for housing a refillable container holding the product, a front door, and a locking mechanism configured to secure the front door of the corresponding storage receptacle in a closed position when disposed in a locked state and to permit the front door of the corresponding storage receptacle to be opened when disposed in an unlocked state. In an exemplary embodiment, each locking mechanism is predisposed in the locked state and configured to be compelled to the unlocked state by and thereafter capture a corresponding vendee key.

A non-limiting, exemplary vending structure is depicted in FIG. 5. By way of illustration, a vending structure 80 has a total of 24 storage receptacles arranged as a matrix of 4 locker columns and 6 locker rows. Obviously, the number of storage receptacles in a vending structure can vary and be less than or greater than 24 in particular embodiments.

The vending structure 80 has a frame 94, which holds the storage receptacles together at the vending structure's perimeter, and a base 96. Each storage receptacle includes a compartment (not shown) suitable for housing a refillable container holding the product, a front door 84, and a locking mechanism 86. An identifying locker number 98 is located on the front surface of each locking mechanism 86 to designate the corresponding storage receptacle 84.

In the exemplary vending structure 80, each locking mechanism 86 has a two-keyway design that is configured to secure the front door of the corresponding storage receptacle in a closed position when locked and to permit the front doors of the respective storage receptacles to be opened when unlocked. The locking mechanisms 86 are shown in FIG. 5 in the locked state with the front doors 84 closed.

Each locking mechanism 86 includes a vendee keyway 88 configured to unlock the locking mechanism when a corresponding vendee turnkey is inserted into and rotated inside the vendee keyway, and to thereafter capture the corresponding vendee turnkey so that it cannot be removed from the vendee keyway. Each locking mechanism 86 further includes a vendor keyway 90 in which a vendor turnkey can be inserted into and rotated to release a vendee turnkey that has been captured in vendee keyway 88 so that the vendee turnkey may be removed.

In accordance with an exemplary embodiment, the storage receptacles of the vending structure can be modular so that they may be constructed with standardized units or dimensions allowing for flexibility and variety in use and arrangement, thereby permitting the vended products to consist of whatever the retailer desires to vend in a secured or controlled fashion, and permitting the vending structure to be placed in any location and be of any size and arrangement suitable for vending the products. By way of example, the product can be a predetermined amount of propane, and the refillable containers can consist of refillable propane tanks configured to hold the predetermined amount of propane. In an exemplary vending structure, each storage receptacle can be assigned a module number, and the plurality of storage receptacles can be arranged within the vending structure in a sequence of module numbers.

In accordance with an exemplary embodiment, a method of vending secured products to consumers comprises the steps of removing empty refillable containers from the compartments of the plurality of storage receptacles to the extent that empty refillable containers are present, depositing refillable containers holding the product into the compartments of the plurality of storage receptacles to the extent that storage receptacles are present in which refillable containers are not deposited, releasing a corresponding vendee key for each locking mechanism of the plurality of storage receptacles for which a corresponding vendee key has not been released, transferring a released vendee key to each consumer purchasing the product, whereby each purchasing consumer can compel the locking mechanism corresponding to the transferred vendee key to the unlocked state and be permitted to open the front door of the corresponding storage receptacle of the plurality of storage receptacles to access the corresponding compartment, obtain a refillable container holding the product, and deposit an empty refillable container into the compartment; and capturing the vendee keys as the vendee keys are used to compel a corresponding locking mechanism to the unlocked state so that each vendee key, when captured, cannot be used to compel a corresponding locking mechanism to the unlocked state unless subsequently released.

The steps of removing empty refillable containers from the compartments of the storage receptacles and depositing refillable containers holding the product into the compartments of the storage receptacles can be accomplished in various ways without departing from the principles of exemplary embodiments of the present invention. For example, each storage receptacle can include a rear door panel, or the vending structure can include a single rear door which, when opened, provides access to every compartment of the plurality of storage receptacles at the same time. This allows an attendant, or, to reduce labor costs and heighten safety and security, a courier, to easily remove and deposit refillable containers into the compartments through a rear door. The compartments can also be loaded and unloaded from the front.

Figure 6:
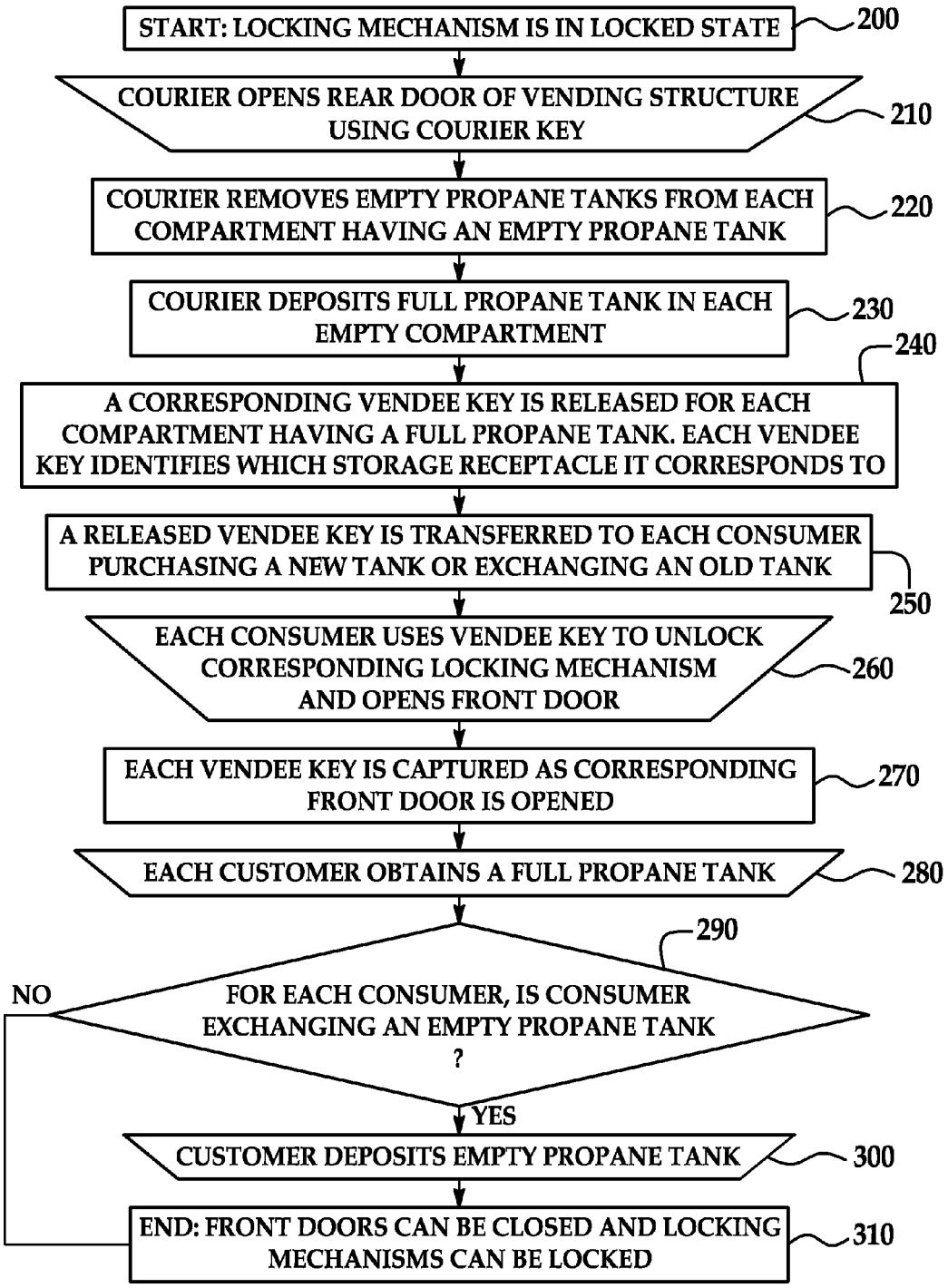
FIG. 6 is a schematic illustrations of an exemplary embodiment of the method of the present invention.
Figure 7:
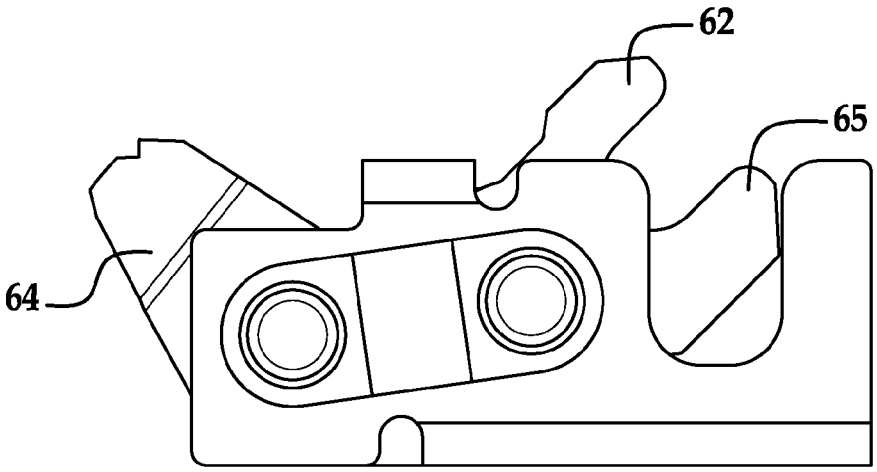
FIGS. 7-15 illustrate components of an exemplary embodiment of the present invention.
Figure 8:
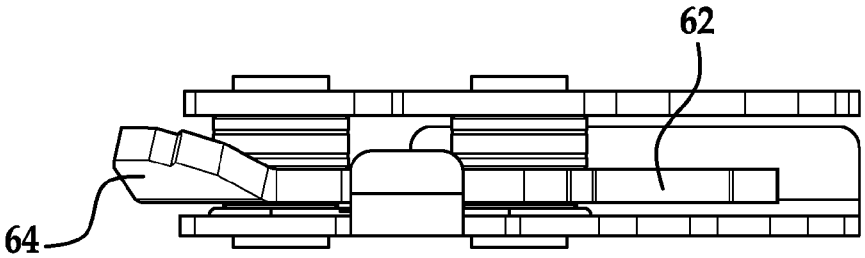
Figure 9:
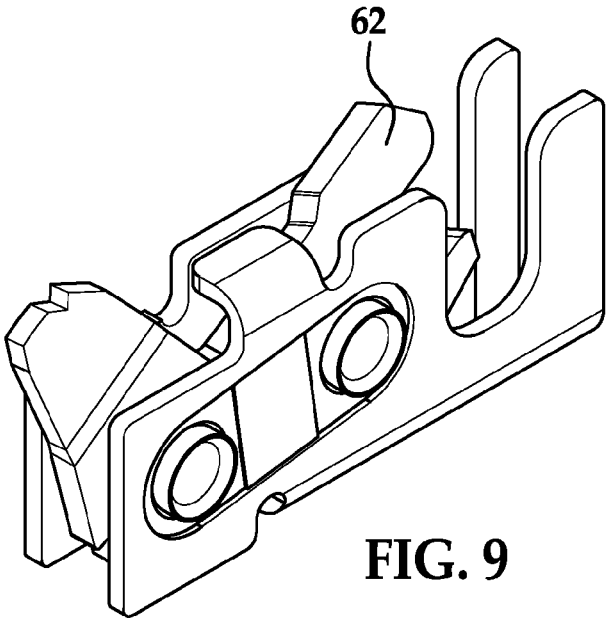
Figure 10:
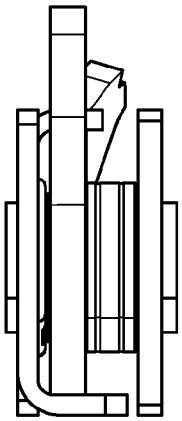
Figure 11:
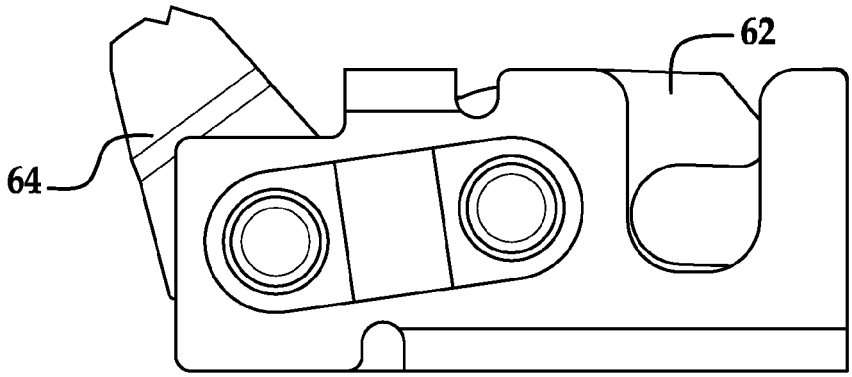
Figure 12:
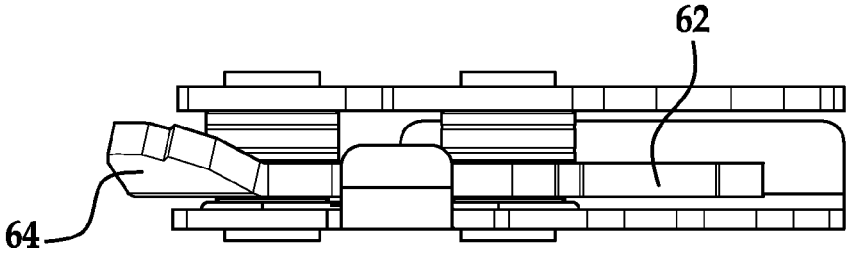
Figure 13:
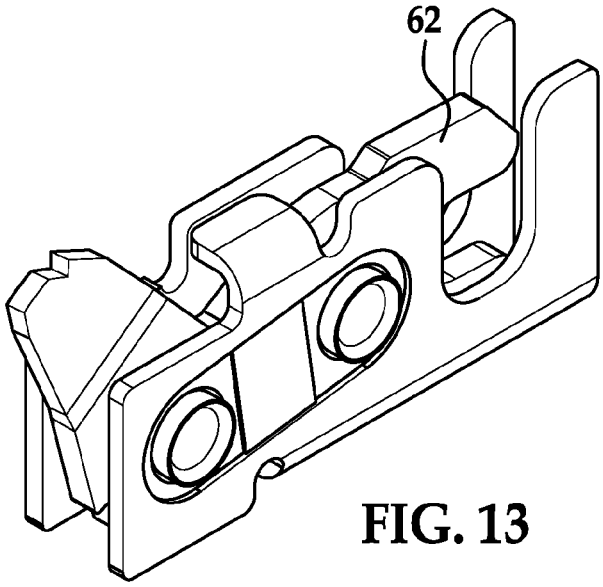
Figure 14:
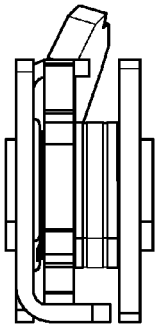

The method of vending secured products to consumers in accordance with exemplary embodiments of the present invention can be utilized, in a non-limiting exemplary embodiment, for the purpose of implementing a retail propane tank exchange program, as illustrated by way of example in the flowchart in FIGS. 6-7. The propane tank exchange program can be implemented using the exemplary storage receptacle 80 illustrated in FIG. 5 and described above. As shown as step 200, the method starts with each locking mechanism disposed in the locked state.

In an exemplary embodiment, the propane exchange program retailer can have a representative or courier from a propane distributor or a municipality collect and refill empty refillable propane tanks rather than bear the entire costs of the removal, refill, and replace labor, the cost of federally regulated transportation of obsolete and damaged propane tanks to a recycling or disposal facility, and the risk of improper refills. As shown in FIG. 6, the courier opens the rear door of the vending structure using a courier key at step 210, removes empty propane tanks from each compartment having an empty propane tank at step 220, and deposits a full propane tank into each empty compartment of the storage receptacle at step 230.

In accordance with an exemplary embodiment, the step of releasing a corresponding vendee key for each locking mechanism of the plurality of storage receptacles can include making a vendee key available to be used to unlock a corresponding locking mechanism for each compartment in which a refillable container holding the product has been deposited. As shown in the exemplary embodiment of FIGS. 6-7, a corresponding vendee key is released for each compartment that houses a full propane tank at step 240, and each vendee key identifies the storage receptacle to which it corresponds.

The vendee keys in accordance with an exemplary embodiment can be of any form suitable for compelling the locking mechanisms of the vending structure to the unlocked state. By way of example, the vendee keys can consist of tokens or stainless steel turnkeys for mechanical locking mechanisms, or, for electrical locking mechanisms, user-assigned access codes or keycards. Access codes or keycards can be entered into a keypad or inserted into a card reader on a corresponding storage receptacle, or entered into an adjacent wall keypad or inserted into an adjacent wall card reader that controls the individual locking mechanisms of every storage receptacle of the vending structure (multiple wall keypads or card readers could also be used to eliminate waiting when multiple consumers are unlocking storage receptacles at the same time). The vendee keys can be manufactured or generated in a proprietary fashion to prevent against duplication or repeated use.

In accordance with an exemplary embodiment, the step of transferring a released vendee key to each consumer can consist of, for example, handing a turnkey, handing or dispensing a token or a keycard, or communicating a user-assigned access code to each consumer who purchasing the product. Each released vendee key corresponds to a storage receptacle of the vending structure that contains a refillable container holding the product, and each vendee key is provided for only one distinct purchase. A module number for the storage receptacle corresponding to the vendee key transferred can be communicated to each consumer. Pursuant to a non-limiting exemplary embodiment, the transferring step can take place at a remote, central location, and thereby would require minimal attendant labor and consumer wait time.

In the exemplary embodiment of a propane tank exchange program illustrated in FIGS. 6-7, each consumer can have the option of purchasing a full propane tank without an exchange or trading in an empty tank for a full propane tank at a lower cost. Each consumer in a series of purchasing consumers is transferred a vendee key corresponding to one of the vending structure's storage receptacles that holds a full refillable propane tank at step 250. Each consumer can use the vendee key received for their distinct purchase to unlock the corresponding storage receptacle's locking mechanism at step 260 and, in so doing, can open the front door of the corresponding storage receptacle to access a compartment housing a full propane tank. Each consumer can then obtain the full propane tank at step 280 and, if exchanging at step 290, deposit their empty propane tank into the compartment at step 300. By permitting consumers to deposit their empty propane tanks into the vending structure in the exemplary propane tank exchange program, exemplary embodiments of the present invention eliminates the hazard of having consumers deposit empty tanks at an exchange display near the store entrance and also permits consumers to obtain full propane tanks without the assistance of an attendant, as previously required by propane tank exchange programs.

The step of capturing the vendee keys as the vendee keys are used to unlock the corresponding locking mechanism secures the integrity of the system. In the exemplary embodiment of FIG. 6-7, the capturing of each vendee key at step 270 coincides with the opening of the front door of the corresponding locking mechanism.

In carrying out an exemplary embodiment, it is contemplated that the capturing of a vendee key can consist of, by way of example, trapping a turnkey in a mechanical locking mechanism, retaining a token vendee key is a token retaining housing once it has been inserted into a corresponding locking mechanism, or deactivating an access code or keycard so that it cannot be used to unlock a corresponding locking mechanism a second time. After each vendee key is used to unlock a corresponding lock mechanism and a consumer has accessed the compartment of the corresponding storage receptacle by opening the front door, the front door can be closed and locked. Because the corresponding vendee key has been captured, when a locking mechanism is locked after a consumer has accessed the corresponding compartment, as can be performed at step 310 of the exemplary embodiment of FIGS. 6-7, the consumer cannot use the vendee key to re-enter the compartment.

In accordance with an exemplary embodiment, each vendee key, when captured, cannot be used to unlock a corresponding locking mechanism unless subsequently released. The step of releasing vendees key can consist of, by way of example, removing trapped turnkeys from the locking mechanisms using a manager or vendor key, removing token vendee keys from a token retaining housing within the vending structure using a vendor key that opens the token retaining housing, or programming access codes or activating keycards that will compel the software of electrical locking mechanisms to release vendee keys upon reading the vendor access code or keycard. In example described, a single vendor key may be used to compel the release of each captured vendee key individually, or a single vendor key may be used to compel the release of a vendee key for each locking mechanism simultaneously.

Figure 15:
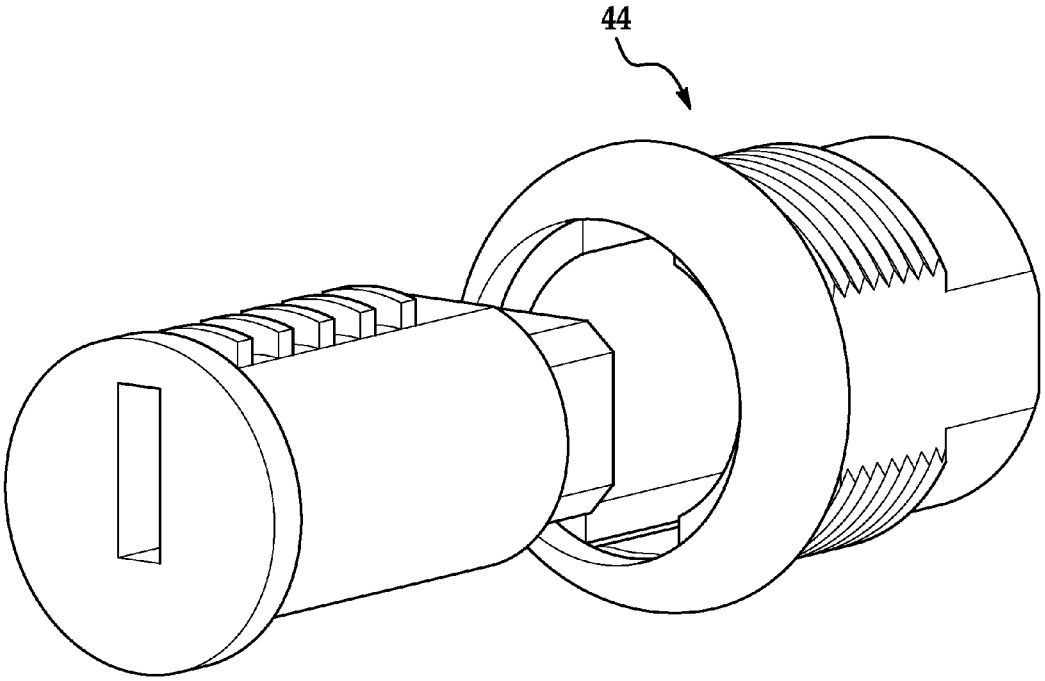

FIGS. 7-15 illustrate components of an exemplary embodiment of the present invention. FIGS. 7-10 illustrate the rotary latch in an open position while FIGS. 11-14 illustrate the rotary latch in a closed position. FIG. 15 is an exploded view of the first locking mechanism illustrating the plug, key opening, housing and pins that are depressed in order to allow the plug to rotate.

While the invention has been described with reference to one or more exemplary embodiments, it will be understood by those skilled in the art that various changes may be made, the various steps may be accomplished in different ways, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A lock mechanism, comprising:

a rotary latch configured for rotation between a locked position and an unlocked position, the rotary latch rotating in a first plane and the rotary latch is retained in the locked position after it has been rotated into the locked position from the unlocked position, the rotary latch being spring biased into the unlocked position by a biasing member; and a first locking mechanism for releasing the rotary latch from the locked position after rotation of the rotary latch into the locked position, the first locking mechanism having a planar member being configured to directly contact a latch trigger of the rotary latch and move from a first position to a second position, wherein the rotary latch is only capable of being manipulated back into the unlocked position from the locked position only after movement of the planar member of the first locking mechanism into the second position, wherein movement of the planar member of the first locking mechanism from the first position to the second position is only in a second plane that is not parallel to the first plane and wherein the planar member of the first locking mechanism must be returned to the first position in order to subsequently re-release the rotary latch from the locked position, further comprising a second locking mechanism, the second locking mechanism engaging a projection depending away from the planar member of the first locking mechanism after the first locking mechanism has released the rotary latch from the locked position and has moved into the second position, the second locking mechanism being configured to prevent the planar member of the first locking mechanism from subsequently returning to the first position from the second position by contacting the projection.

2. The lock mechanism as in claim 1, wherein the rotary latch further comprises a latch portion, the latch portion and the latch trigger, each being rotationally mounted to the lock mechanism for rotation in the first plane, the latch portion being biased into the unlocked position by the biasing member and latch trigger is biased in a direction opposite to a biasing direction of the biasing member of the latch portion, wherein the latch trigger engages and retains the latch portion in the locked position when the latch portion is rotated into the locked position and the planar member of the first locking mechanism releases the rotary latch from the locked position by rotating the latch trigger away from the latch portion after the latch trigger has engaged the latch portion.

3. The lock mechanism as in claim 1, wherein the rotary latch further comprises an opening and the rotary latch is rotatably received within a pair of sidewalls each having an opening, the opening of the rotary latch being perpendicularly arranged with the opening in the pair of sidewalls when the rotary latch is in the locked position.

* * * * *